US008201923B2

(12) United States Patent
Fujii

(10) Patent No.: US 8,201,923 B2
(45) Date of Patent: Jun. 19, 2012

(54) INK JET RECORDING HEAD AND METHOD FOR MANUFACTURING SAME

(75) Inventor: Tatsunori Fujii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/636,031

(22) Filed: Dec. 11, 2009

(65) Prior Publication Data

US 2010/0149261 A1 Jun. 17, 2010

(30) Foreign Application Priority Data

Dec. 17, 2008 (JP) ..... 2008-320824

(51) Int. Cl.
*B41J 2/14* (2006.01)

(52) U.S. Cl. ..... 347/47

(58) Field of Classification Search ..... 347/40, 347/43, 47, 64–65; 29/890.1
See application file for complete search history.

(56) References Cited

U.S. PATENT DOCUMENTS 5,659,343 A * 8/1997 Koizumi et al. ..... 347/47
6,097,411 A * 8/2000 Maeoka et al. ..... 347/63
6,331,051 B1 * 12/2001 Tajima et al. ..... 347/65

FOREIGN PATENT DOCUMENTS

JP 2005-238762 A 9/2005
JP 2006-212902 8/2006
JP 2006-212902 A 8/2006

* cited by examiner

*Primary Examiner* — Lamson Nguyen
(74) *Attorney, Agent, or Firm* — Canon USA Inc IP Division

(57) ABSTRACT

An ink jet recording head includes a recording element substrate and a supporting member. The recording element substrate has an energy generating element that generates energy used for discharging liquid. The supporting member has a plurality of supply paths that are through holes facilitating supplying liquid to the recording element substrate, and supports the recording element substrate. A first protrusion is provided on a surface of the supporting member in contact with adhesive for bonding the recording element substrate, and at each end in the longitudinal direction of each of partition walls formed between the plurality of supply paths.

9 Claims, 10 Drawing Sheets

INK JET RECORDING HEAD AND METHOD FOR MANUFACTURING SAME

BACKGROUND OF THE INVENTION

1. Field of the Invention

The present invention relates to an ink jet recording head and a method for manufacturing the same.

2. Description of the Related Art

FIGS. 9A and 9B are appearance perspective views schematically showing a color cartridge 100 that is an ink jet recording head. FIG. 9A is a view from beneath. FIG. 9B is a view from above. The color cartridge 100 includes a supporting member 109 and a lid 110 that define a recording liquid chamber that holds recording liquid. A recording element substrate 101 for discharging recording liquid droplets and an electric wiring substrate 102 are attached to the supporting member 109.

FIGS. 10A and 10B are schematic views of the recording element substrate 101. FIG. 10A shows the side of the recording medium (the face). FIG. 10B shows the side of the supporting member 109 (the back). FIGS. 11A and 11B are schematic views of a bonding surface 115 of the supporting member 109 to which the recording element substrate 101 is bonded. FIG. 11A shows the bonding surface 115 before applying adhesive 104 thereto. FIG. 11B shows the bonding surface 115 after applying adhesive 104 thereto.

The area around supply paths 106 of the supporting member 109 and the upper surfaces of partition walls 108 between the supply paths 106 constitute the bonding surface 115. Adhesive 104 is applied to the bonding surface 115. The back of the recording element substrate 101 is bonded to the bonding surface 115 of the supporting member 109 with the adhesive 104 therebetween. Recording liquid is supplied from the recording liquid chamber through the supply paths 106 to recording liquid supply ports 105 formed in the recording element substrate 101. The supplied recording liquid is caused to form bubbles by heating elements (not shown) formed in the recording element substrate 101, is discharged through discharge ports 103, and lands on a recording medium.

If the back of the recording element substrate 101 is insufficiently bonded to the bonding surface 115 of the supporting member 109 and the gap therebetween is insufficiently sealed, recording liquid can leak through the gap. Therefore, adhesive 104 must be applied to the entire bonding surface 115 so that the gap between the recording element substrate 101 and the bonding surface 115 of the supporting member 109 can be sealed with the adhesive 104.

Japanese Patent Laid-Open No. 2006-212902 discloses a supporting member having V-shaped grooves formed in portions of a bonding surface of the supporting member that come into contact with regions surrounding recording liquid supply ports of a recording element substrate when the back of the recording element substrate is bonded to the bonding surface of the supporting member. The grooves hold adhesive and prevent lines of adhesive from breaking, thereby improving the sealing performance between the recording element substrate and the bonding surface of the supporting member.

From the standpoint of cost, workability, and so forth, the supporting member 109 is formed by molding. Since the supporting member 109 is formed by molding, the flatness of the bonding surface 115 is not so high. So, the recording element substrate is fixed in the following way.

First, lines of adhesive 104 are drawn on the bonding surface 115 of the supporting member 109 using a dispenser (not shown). The recording element substrate 101 the position and attitude of which are adjusted with a high degree of accuracy is brought into contact with the adhesive 104 at a predetermined height, for example, 70 μm above the bonding surface 115. This state is maintained until the adhesive 104 is cured. Thereafter, the area around the recording element substrate 101 and the electric connecting portions of the recording element substrate 101 are sealed with sealant, the sealant is thermally cured, and the recording element substrate 101 is thereby fixed.

In this way, the recording element substrate 101 can be bonded and fixed regardless of the flatness of the bonding surface 115 of the supporting member 109. However, in this way, the recording element substrate 101 is fixed, while floating in the adhesive 104. If the surface of applied adhesive 104 is not uniform in height and is partially less than 70 μm high, the adhesive 104 cannot perfectly come into contact with the recording element substrate 101, and seal failures can occur. Therefore, when applying adhesive 104, it is necessary not only to draw unbroken lines of adhesive 104 but also to stabilize the height of the surface of adhesive 104.

FIGS. 12A to 12C are schematic views showing adhesive 104 applied to the bonding surface 115 of the supporting member 109.

FIG. 12A shows the bonding surface 115 of the supporting member 109 to which adhesive 104 is applied. The adhesive 104 is also applied to the partition walls 108 in order to seal the gap between the area around the supply paths 106 of the supporting member 109 and the area around the recording liquid supply ports 105 of the recording element substrate 101. FIG. 12B is an enlarged view of the part XIIB of FIG. 12A. The pattern of applied adhesive 104 has rounded corners 117. Near the corners 117 are a region c where surface tension γ concentrates and a region d where surface tension γ disperses. The layer of adhesive 104 is thick in the region c where surface tension γ concentrates and thin in the region d where surface tension γ disperses. That is to say, the layer of adhesive 104 is thick on the center lines of the partition walls 108, and particularly at the intersection of the center lines. In contrast, the area around the thick portion is relatively thin. This makes the surface of adhesive 104 uneven as shown in FIG. 12C. In low portions such as the region d, the adhesive 104 can be out of contact with the back of the recording element substrate 101. In such a case, the gap between the recording liquid supply ports 105 of the recording element substrate 101 and the supply paths 106 of the supporting member 109 is insufficiently sealed, and it is highly likely that recording liquid leaks and sealant enters. If the amount of application is increased to thicken the layer of adhesive 104, it is likely that the adhesive 104 falls into the supply paths 106 of the supporting member 109 and climbs up from the recording liquid supply ports 105 of the recording element substrate 101 to the discharge ports 103. This lowers the margin with respect to the height of the surface of applied adhesive, and as a result, lowers productivity.

SUMMARY OF THE INVENTION

The present invention provides an ink jet recording head in which the gap between a supporting member and a recording element substrate is tightly sealed with adhesive without reducing productivity, and a method for manufacturing the same.

In an aspect of the present invention, an ink jet recording head includes a recording element substrate and a supporting member. The recording element substrate has an energy generating element that generates energy used for discharging liquid. The supporting member has a plurality of supply paths that are through holes facilitating supplying liquid to the recording element substrate, and supports the recording element substrate. A first protrusion is provided on a surface of the supporting member in contact with adhesive for bonding the recording element substrate, and at each end in the longitudinal direction of each of partition walls formed between the plurality of supply paths.

Further features of the present invention will become apparent from the following description of exemplary embodiments with reference to the attached drawings.

BRIEF DESCRIPTION OF THE DRAWINGS

FIG. 1A is an appearance perspective view from beneath. FIG. 1B is an appearance perspective view from above.

FIG. 3A is a schematic view of the side of the recording medium (the face). FIG. 3B is a schematic view of the side of the supporting member (the back).

FIG. 4A is a plan view showing the bonding surface. FIG. 4B is a sectional view taken along line IVB-IVB of FIG. 4A. FIG. 4C is a sectional view showing another shape of the protrusion. FIG. 4D is a sectional view showing still another shape of the protrusion.

FIG. 6A is a plan view showing the bonding surface. FIG. 6B is a sectional view taken along line VIB-VIB of FIG. 6A.

FIG. 9A is an appearance perspective view from beneath. FIG. 9B is an appearance perspective view from above.

FIG. 10A is a schematic view of the side of the recording medium (the face). FIG. 10B is a schematic view of the side of the supporting member (the back).

FIG. 11A is a schematic configuration diagram of the bonding surface before applying adhesive thereto. FIG. 11B is a schematic configuration diagram of the bonding surface after applying adhesive thereto.

FIG. 12A is a plan view showing the bonding surface. FIG. 12B is an enlarged schematic view of the part XIIB of FIG. 12A. FIG. 12C is a sectional view taken along line XIIC-XIIC of FIG. 12B.

DESCRIPTION OF THE EMBODIMENTS

Figure 1A:
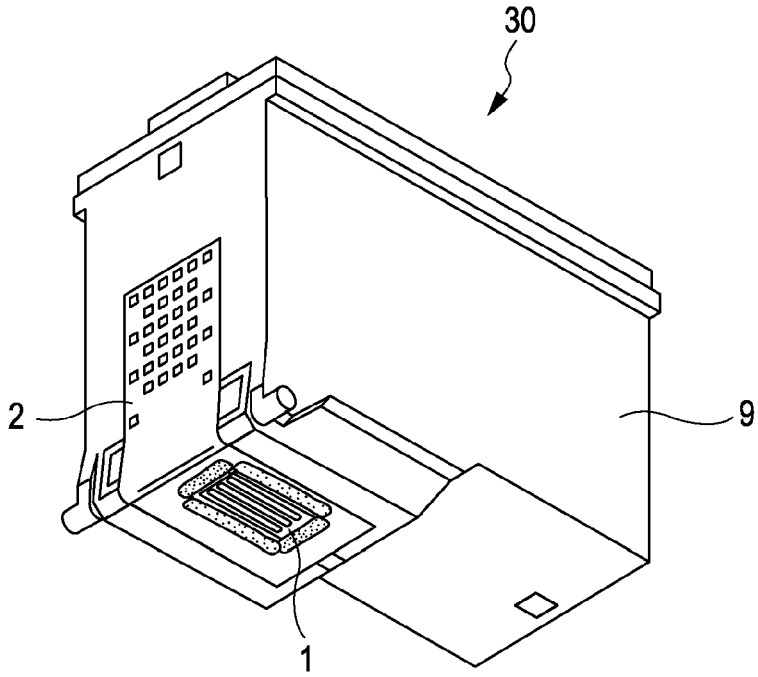
FIGS. 1A and 1B are appearance perspective views of an ink jet recording head of the present invention.

The embodiments of the present invention will now be described with reference to the drawings. In the drawings, the same reference numerals will be used to designate components having the same function, and redundant description will be omitted.

Figure 1B:
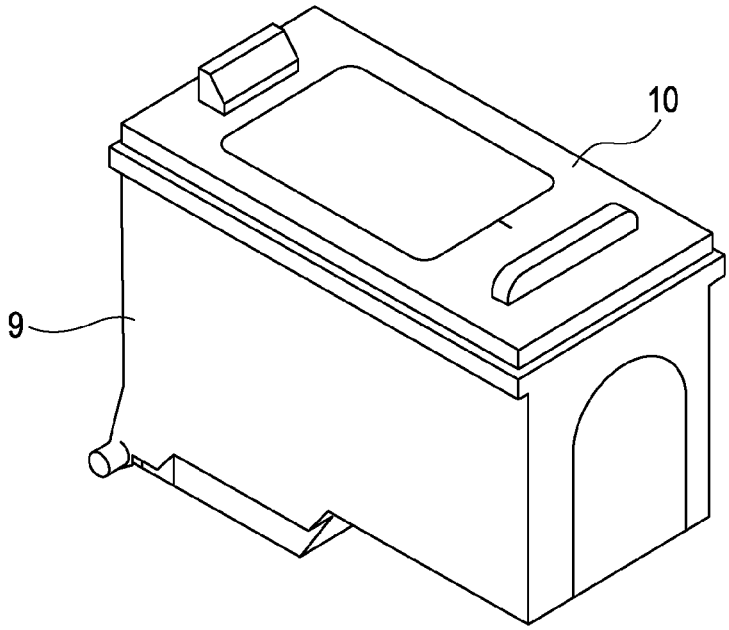
Figure 2:
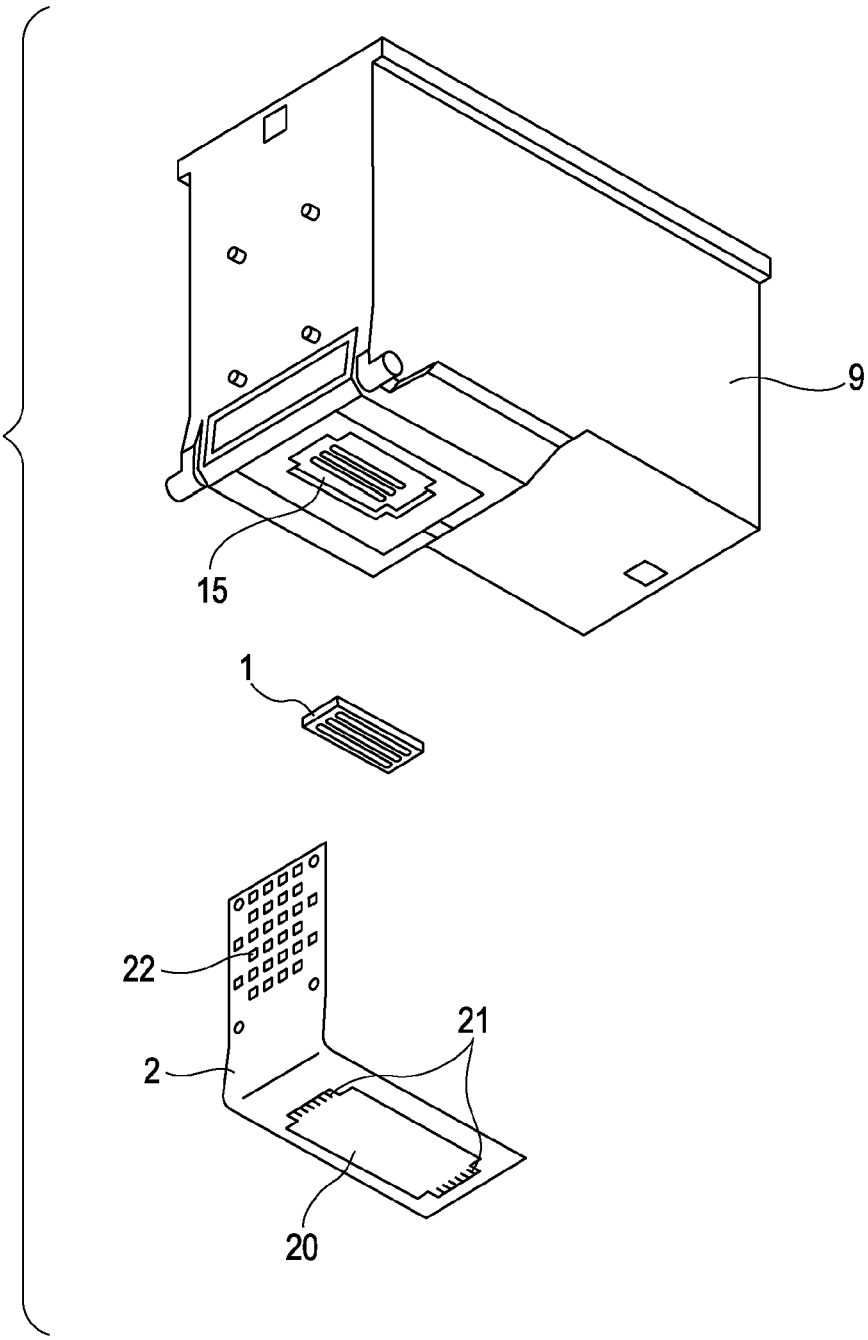
FIG. 2 is an exploded perspective view of the ink jet recording head in FIGS. 1A and 1B.

FIGS. 1A and 1B are appearance perspective views schematically showing a color cartridge 30 that is an ink jet recording head of the present invention. FIG. 1A is a view from beneath. FIG. 1B is a view from above. FIG. 2 is an exploded perspective view of the color cartridge 30.

The color cartridge 30 includes a supporting member 9 and a lid 10 that define recording liquid chambers that hold yellow (Y), magenta (M), and cyan (C) recording liquids (not shown). The recording liquid chambers house absorbers (not shown) for holding the recording liquids. The supporting member 9 is formed by molding. A recording element substrate 1 for discharging the recording liquids is attached to a bonding surface 15 at the bottom of the supporting member 9. In the following embodiments, the supporting member 9 is molded of a mixture of 65% resin material and 35% glass filler to enhance the shape rigidity.

Figure 3A:
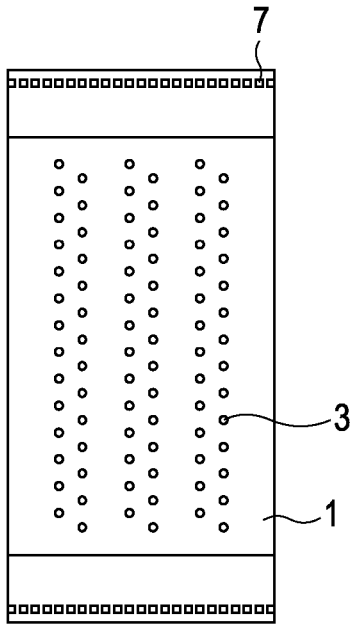
FIGS. 3A and 3B are schematic views of the recording element substrate of the ink jet recording head in FIGS. 1A and 1B.
Figure 3B:
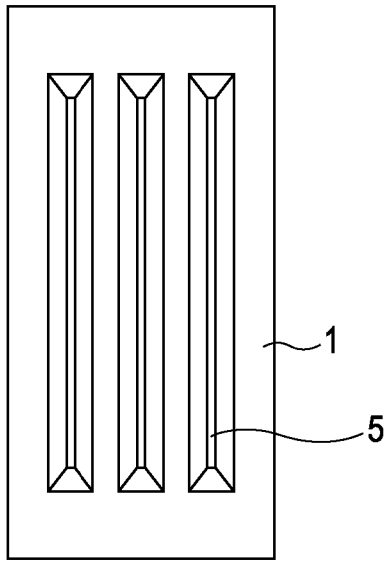

FIGS. 3A and 3B are schematic views of the recording element substrate 1. FIG. 3A shows the side of the recording medium (the face). FIG. 3B shows the side of the supporting member 9 (the back). The recording element substrate 1 has heating elements (not shown) for discharging the recording liquids, flow paths (not shown), discharge ports 3, and recording liquid supply ports 5. The recording element substrate 1 is connected to an electric wiring substrate 2. As shown in FIG. 2, the electric wiring substrate 2 has a device hole 20 in which the recording element substrate 1 is fitted, and electrode terminals 21 corresponding to electrodes 7 of the recording element substrate 1. The electric wiring substrate 2 further has external signal input terminals 22 for receiving drive control signals from the recording apparatus main body. The external signal input terminals 22 are connected to the electrode terminals 21 by copper foil wiring.

Figure 4A:
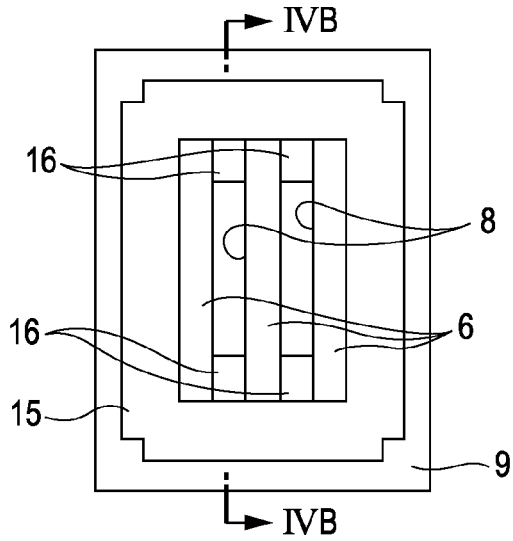
FIGS. 4A to 4D are schematic configuration diagrams of an embodiment of an ink jet recording head of the present invention.

A first embodiment according to the present invention will be described. FIGS. 4A to 4D are schematic configuration diagrams of an embodiment of a recording apparatus according to the present invention. The supporting member 9 and the bonding surface 15 shown FIG. 4A are formed by molding. The supporting member 9 has recording liquid supply paths 6 for supplying recording liquids, and partition walls 8 are formed so that the recording liquids do not mix.

Figure 4B:
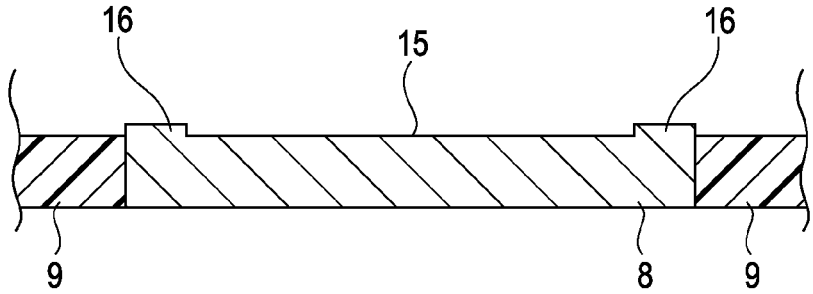
Figure 4C:
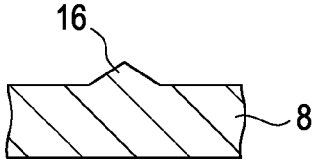
Figure 4D:
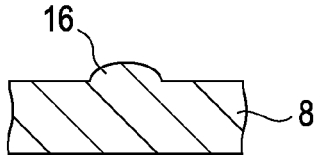

At each end of the upper surface of each partition wall 8 is formed a protrusion 16 that is rectangular in cross section as shown in FIG. 4B. The shape of the protrusions 16 is determined in consideration of the properties of the molding material, the physical properties of the adhesive, and so forth. The cross section of the protrusions is not limited to rectangular and may be triangular as shown in FIG. 4C or semicircular as shown in FIG. 4D.

Figure 5:
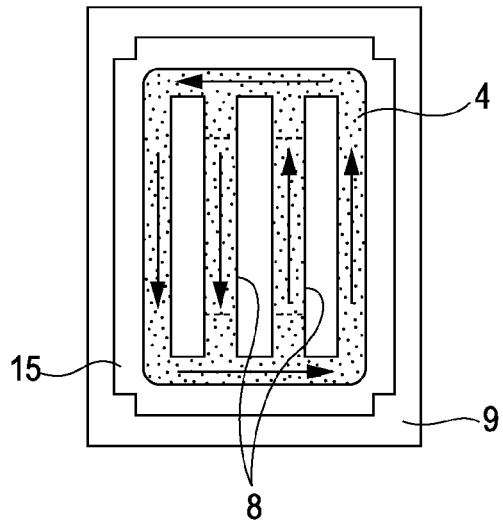
FIG. 5 is a plan view showing a method for applying adhesive.

As shown in FIG. 5, a dispenser (not shown) draws lines of adhesive 4 on the bonding surface 15 while moving in the directions of arrows. Alternatively, a pattern of adhesive 4 may be transferred to the bonding surface 15.

Figure 6A:
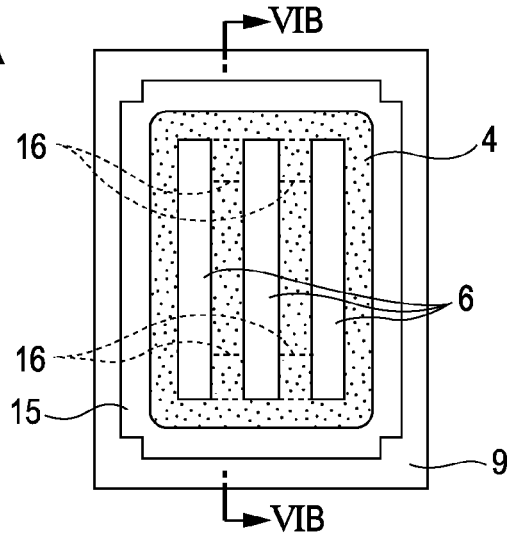
FIGS. 6A and 6B are schematic views showing the bonding surface of the ink jet recording head in FIGS. 4A to 4D to which adhesive is applied by the method in FIG. 5.
Figure 6B:
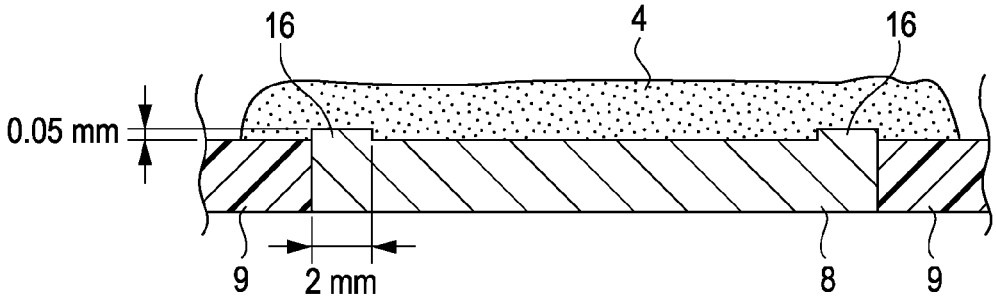

FIGS. 6A and 6B show the bonding surface 15 to which adhesive 4 is applied. As shown in FIG. 6A, adhesive 4 is applied to the bonding surface 15 including the protrusions 16. FIG. 6B is a sectional view taken along line VIB-VIB of FIG. 6A. Adhesive 4 is applied to the bonding surface 15 by an application needle of the dispenser (not shown). As shown in FIG. 6B, the protrusion 16 provided at each end of each partition wall 8 raises adhesive 4, thereby reducing the lowering of the surface of adhesive 4.

A protrusion 0.05 mm high and 2 mm wide was formed at each end of each partition wall 8. An adhesive having a viscosity of 12,000 mPa·s and a thixotropic ratio of 1.5 was used. The height of the surface of adhesive was measured. Compared to the case where no protrusion is provided at each end of each partition wall 8, the lowering of the surface of adhesive was reduced by about 40%.

A second embodiment according to the present invention will be described.

Figure 7:
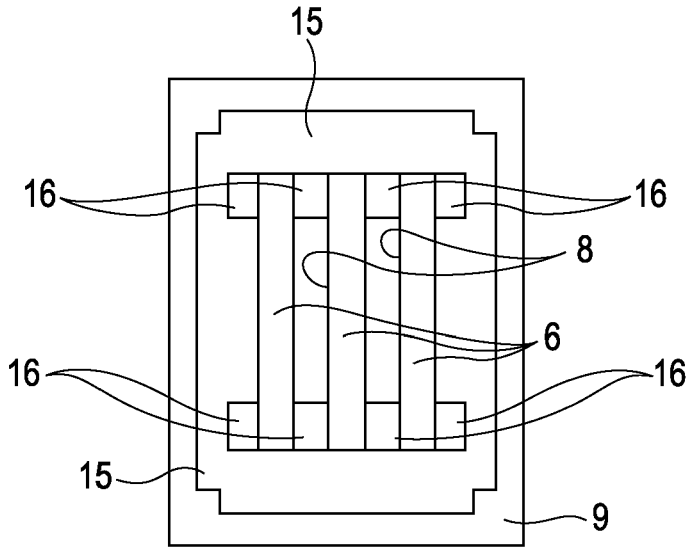
FIG. 7 is a schematic configuration diagram showing another embodiment of an ink jet recording head of the present invention.

As shown in FIG. 7, in this embodiment, protrusions 16 are provided not only on the upper surfaces of the partition walls 8 but also on the bonding surface 15. The protrusions 16 on the bonding surface 15 are located outside the corners of the supply paths 6 and face the protrusions 16 on the partition walls 8 across the supply paths 6. The protrusions 16 on the partition walls 8 prevent color mixture, and in addition, the protrusions 16 on the bonding surface 15 reduce the lowering of the surface of adhesive 4. This increases the area of contact between the recording element substrate 1 and adhesive 4, thereby enhancing attachment and preventing sealant from entering.

Protrusions 0.05 mm high and 2 mm wide were formed on the upper surfaces of the partition walls 8 and the bonding surface 15. Adhesive 4 was applied using a dispenser. Compared to the case where no protrusions are provided on the bonding surface 15, the lowering of the surface of adhesive was reduced by about 40%.

A third embodiment according to the present invention will be described.

Figure 8:
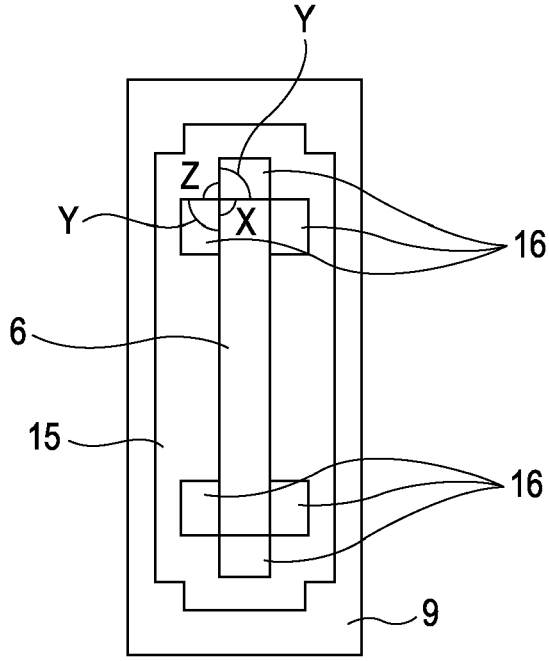
FIG. 8 is a schematic configuration diagram showing still another embodiment of an ink jet recording head of the present invention.
Figure 9A:
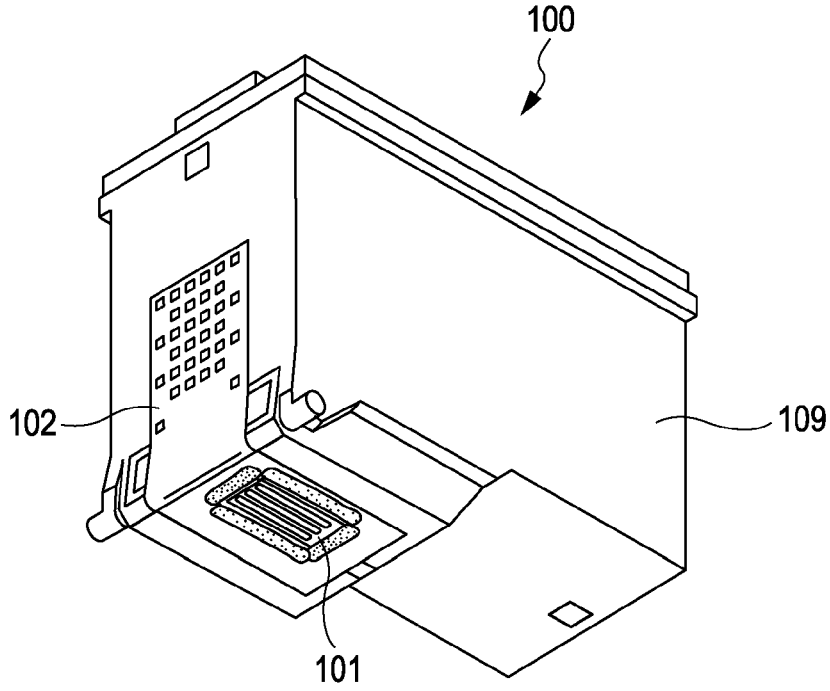
FIGS. 9A and 9B are appearance perspective views of a conventional ink jet recording head.
Figure 9B:
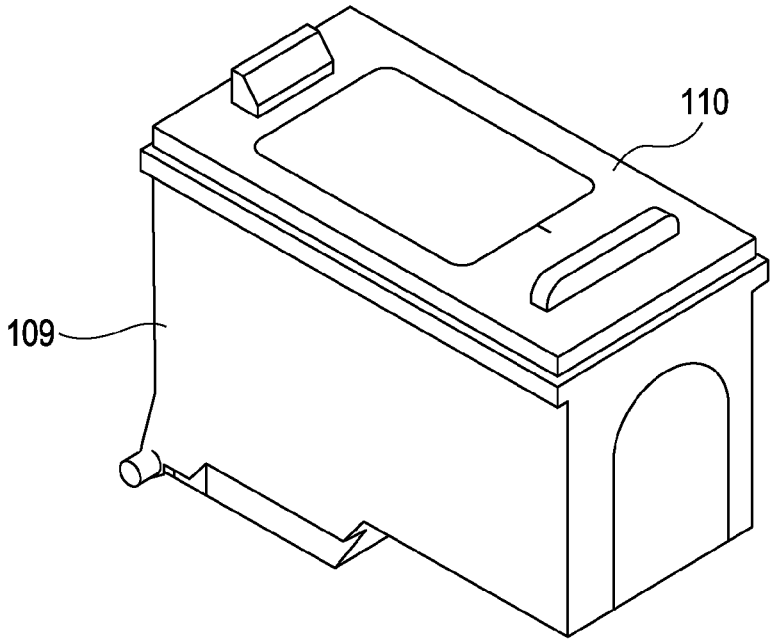
Figure 10A:
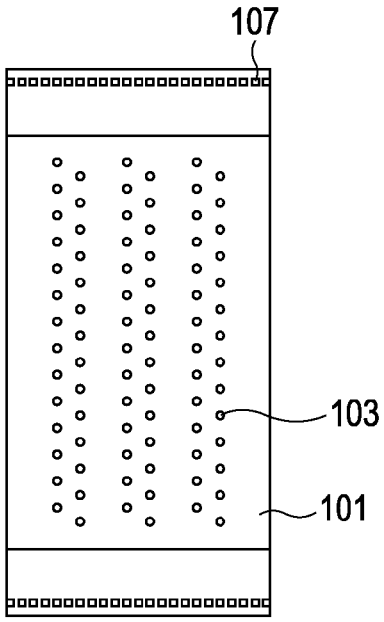
FIGS. 10A and 10B are schematic views of the recording element substrate of the ink jet recording head in FIGS. 9A and 9B.
Figure 10B:
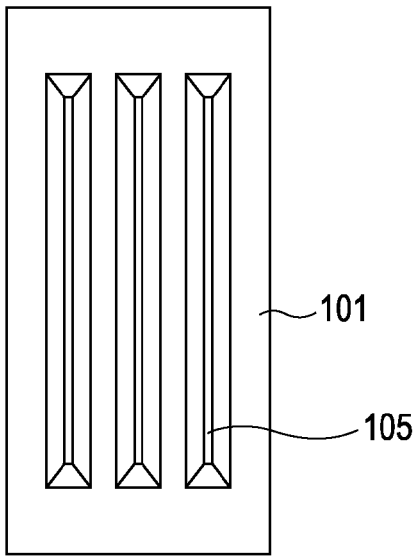
Figure 11A:
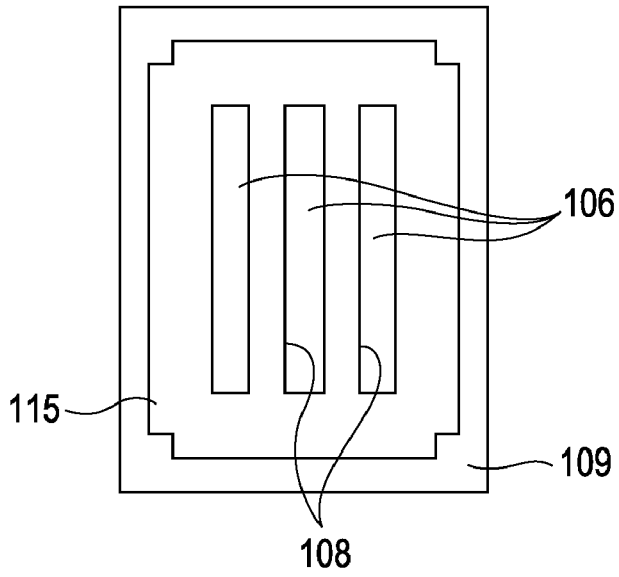
FIGS. 11A and 11B are schematic configuration diagrams of the bonding surface of the ink jet recording head in FIGS. 9A and 9B.
Figure 11B:
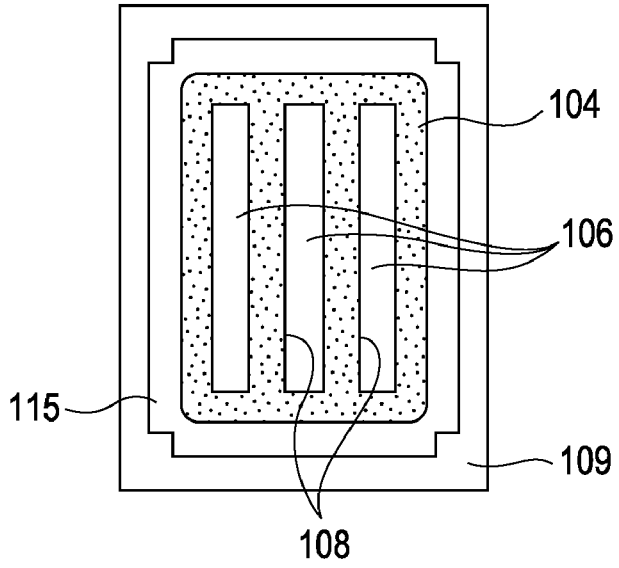

In a single-color cartridge, as shown in FIG. 8, protrusions 16 are formed in the portions Y of the bonding surface 15. The portions Y are portions outside the corners of the supply path 6 except for the portions Z opposite the corners X of the supply path 6. This facilitates the contact between adhesive 4 and the recording element substrate 1, thereby enhancing attachment and preventing sealant from entering.

Protrusions 0.05 mm high were formed on the bonding surface 15 near the corners of the supply path 6. Adhesive 4 was applied to the bonding surface 15 using a dispenser. Compared to the case where no protrusions are provided on the bonding surface 15, the lowering of the surface of adhesive was reduced by about 40%.

Figure 12A:
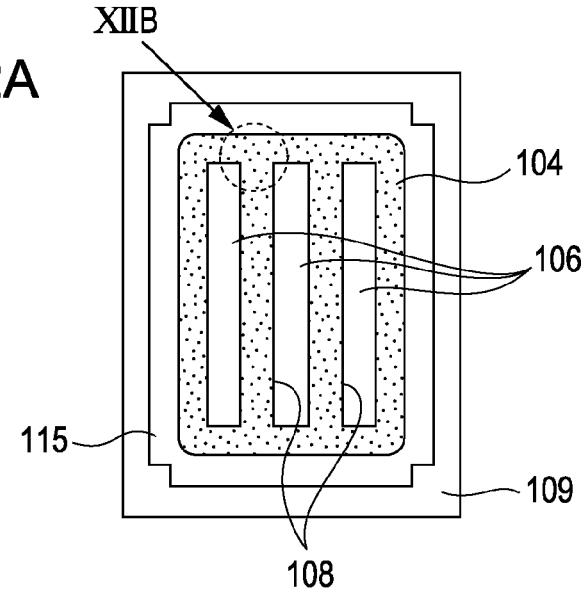
FIGS. 12A to 12C are schematic views showing the bonding surface of the ink jet recording head in FIGS. 11A and 11B to which adhesive is applied.
Figure 12B:
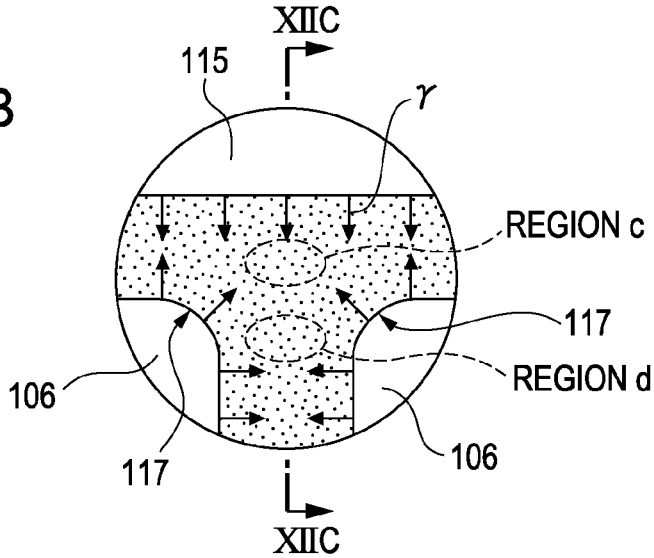
Figure 12C:
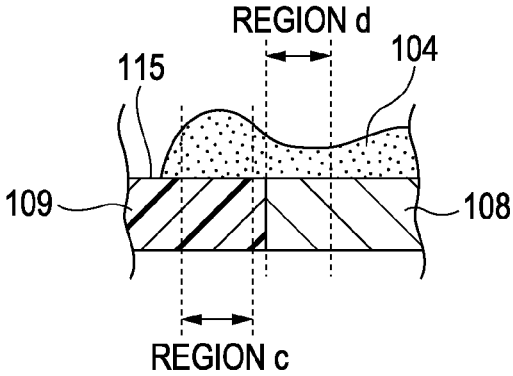

In the case of related art, in a region where surface tension γ disperses, such as the region d of FIGS. 12B and 12C, the layer of applied adhesive 104 is thin. Therefore, at some places, the surface of adhesive 104 is too low to come into contact with the recording element substrate 101. This lowers the reliability of bonding between the supporting member 109 and the recording element substrate 101. However, in the case of the present invention, protrusions 16 are provided in the regions on the bonding surface 15 where surface tension γ of adhesive 4 disperses and the layer of adhesive 4 is thin, and the height of the surface of adhesive 4 can thereby be uniformized. Therefore, the height of adhesive 4 on the bonding surface 15 can be maintained constant, and the sealing performance of adhesive 4 between the recording element substrate 1 and the supporting member 9 can be improved.

In addition, it is not necessary to make a significant change to the process for manufacturing an ink jet recording head, and therefore the manufacturing cost is not significantly increased.

The viscosity of adhesive 4 can be appropriately selected as long as the adhesive 4 can stably keep its shape on the partition walls 8 by meniscus force. Although the ink jet recording heads of the embodiments use three colors of recording liquid or single color recording liquid, the number of colors of recording liquid is not limited.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-320824 filed Dec. 17, 2008, which is hereby incorporated by reference herein in its entirety.

What is claimed is:

1. An ink jet recording head comprising:

a recording element substrate having an energy generating element that generates energy used for discharging liquid; and a supporting member having a plurality of supply paths that are through holes facilitating supplying liquid to the recording element substrate, the supporting member supporting the recording element substrate, wherein a first protrusion is provided on a surface of the supporting member in contact with adhesive for bonding the recording element substrate, and at each end in the longitudinal direction of each of partition walls formed between the plurality of supply paths.

2. The ink jet recording head according to claim 1, wherein second protrusions are provided on the surface of the supporting member in contact with the adhesive so as to face the first protrusions across the supply paths.

3. The ink jet recording head according to claim 1, wherein the first protrusion is rectangular in cross section.

4. The ink jet recording head according to claim 1, wherein the first protrusion is triangular in cross section.

5. The ink jet recording head according to claim 1, wherein the first protrusion is semicircular in cross section.

6. A method for manufacturing an ink jet recording head including: a recording element substrate having an energy generating element that generates energy used for discharging liquid; and a supporting member having a plurality of supply paths that are through holes for supplying liquid to the recording element substrate, the supporting member supporting the recording element substrate, the method comprising:

preparing the supporting member in which a first protrusion is provided on a surface of the supporting member and at each end in the longitudinal direction of each of partition walls formed between the plurality of supply paths;

applying an adhesive to the surface of the supporting member; and bonding the supporting member and the recording element substrate.

7. The method according to claim 6, wherein the adhesive is applied to the surface of the supporting member to which the recording element substrate is bonded, by drawing lines of the adhesive on the surface.

8. The method according to claim 6, wherein the adhesive is applied to the surface of the supporting member to which the recording element substrate is bonded, by transferring a pattern of the adhesive to the surface.

9. The method according to claim 6, wherein the supporting member is formed by molding.

* * * * *